US007066718B2

(12) United States Patent
Haga

(10) Patent No.: US 7,066,718 B2
(45) Date of Patent: Jun. 27, 2006

(54) LIQUID RING COMPRESSOR

(75) Inventor: Johan Haga, Kolbotn (NO)

(73) Assignee: Roto International AS, Kolbotn (NO)

( * ) Notice: Subject to any disclaimer, the term of this patent is extended or adjusted under 35 U.S.C. 154(b) by 0 days.

(21) Appl. No.: 10/520,709

(22) PCT Filed: Jul. 9, 2003

(86) PCT No.: PCT/NO03/00243

§ 371 (c)(1),
(2), (4) Date: Jan. 25, 2005

(87) PCT Pub. No.: WO2004/007969

PCT Pub. Date: Jan. 22, 2004

(65) Prior Publication Data

US 2006/0039797 A1 Feb. 23, 2006

(30) Foreign Application Priority Data

Jul. 12, 2002 (NO) ..... 20023393

(51) Int. Cl.
*F04C 19/00* (2006.01)

(52) U.S. Cl. ..... 417/68; 417/410.1; 417/355

(58) Field of Classification Search ..... 417/68, 417/410.1, 355

See application file for complete search history.

(56) References Cited

U.S. PATENT DOCUMENTS 3,894,812 A * 7/1975 Huse ..... 417/68
4,050,851 A * 9/1977 Haavik ..... 417/68
5,722,255 A * 3/1998 Brasz ..... 62/498

FOREIGN PATENT DOCUMENTS

| | | |
|---|---|---|
| DE | 3242931 | 5/1984 |
| DE | 29619930 | 4/1998 |
| EP | 0945621 | 9/1999 |
| WO | WO 98/05866 | 2/1998 |

* cited by examiner

*Primary Examiner*—Charles G. Freay
*Assistant Examiner*—Ryan Gillan
(74) *Attorney, Agent, or Firm*—Christian D. Abel

(57) ABSTRACT

The invention relates to a liquid ring compressor and/or pump, comprising a rotating compressor casing (1), a shaft journal (10) eccentrically located relative to the compressor casing's axis of rotation, with a surrounding bearing (15). One or more compressor wheels (14) with at least one vane are disposed in the compressor casing with the inside of the compressor wheel (14) in abutment against and rotating around the bearing (15) and inlet and outlet ports for the fluid that has to be compressed. When the compressor casing is rotated, a liquid ring (20) is created against the inner wall of the rotating compressor casing (1), which liquid ring (20) together with the compressor wheel (14) forms compression chambers. The liquid ring compressor further comprises at least one magnetic element mounted in the compressor casing (1) adjacent to the compressor wheel (14), where when the compressor casing (1) is rotated, the magnetic element makes the free-running compressor wheel (14) rotate at the same rotational speed as the compressor casing (1).

10 Claims, 4 Drawing Sheets

LIQUID RING COMPRESSOR

The invention relates to a liquid ring compressor and/or a vacuum pump, comprising a rotating compressor casing, with a shaft journal eccentrically located relative to the compressor casing's axis of rotation. About the shaft journal rotate one or more compressor wheels with at least one vane, with the result that when the compressor casing is rotated, a liquid ring is created against the inner wall of the rotating compressor casing, which liquid ring together with the compressor wheel forms compression chambers, from which there are inlet and outlet ports.

Compressors that employ the principle of a liquid ring in the compressor casing and where the compression chambers are formed by the liquid ring and the compressor wheel's vanes are of two types. One type has a static compressor casing with a liquid ring created inside the static compressor casing. With a solution of this kind, a major loss of energy is encountered due to the friction between the static compressor casing and the rotating liquid ring. In a second embodiment the compressor casing is given a rotation which on account of "centrifugal forces" thereby creates a liquid ring along the inner wall of the compressor casing. In the compressor casing there is further provided a freely rotating eccentrically mounted compressor wheel. The compressor wheel has vanes extending into the liquid ring. When the compressor casing is rotated and creates a liquid ring that follows the compressor casing's rotation, the compressor wheel will be drawn along in the rotation owing to the fact that the vanes extend into the liquid ring. The volume of the chambers that are formed between the compressor wheel's vanes and the liquid ring is altered with rotation of the compressor wheel since the compressor wheel is eccentrically mounted relative to the compressor casing's axis of rotation, and one achieves compression or the creation of a vacuum.

One problem that arises with a design like this is that in some cases the compressor wheel obtains a lower rotational speed than the compressor casing. This may occur, for example, when the compressor is working against high pressure or at a low rotational speed. When the compressor wheel obtains a lower rotational speed than the compressor casing, it will result in a braking of the liquid ring, which in turn may lead to the liquid being forced out through the outlet port(s). This could lead to there being too little liquid left in the compressor casing to obtain an effective liquid ring, with the result that the compression capacity is reduced until a return system returns the liquid to the compressor casing. Such a reduction in the compressor wheel's rotational speed relative to the compressor casing leads to loss and reduced efficiency for the compressor.

Several attempts have been made to find solutions for transferring rotational energy between the compressor casing and the compressor wheel in order to make them rotate at the same speed. Mechanical solutions have been tried, but such solutions are highly complicated and cumbersome due to the fact that the compressor wheel is mounted eccentrically in the compressor casing and is therefore not very suitable for the purpose.

In GB 1 562 828 a liquid ring compressor is described where an attempt has been made to solve some of the above-mentioned problem. In this liquid ring compressor with a rotating compressor casing, a ferromagnetic liquid is used in the liquid ring, where the surrounding compressor casing comprises electric coil devices in order to create an electric field in the compressor casing so that the ferromagnetic liquid that is held by the electric field drives the compressor wheel. In this solution it has been ensured that the liquid ring maintains a desired configuration relative to the compressor casing. Even though the liquid is given a desired configuration due to magnetism, on account of its properties as a liquid, the liquid will nevertheless not ensure that the compressor wheel maintains the same rotational speed as the compressor casing.

The object of the present invention is to provide a liquid ring compressor that ensures that the liquid ring compressor's compressor wheel follows the compressor casing's rotational pattern to the greatest possible extent. A second object of the present invention is that the energy transfer from the compressor casing to the compressor wheel should be simple, efficient and as maintenance-free as possible. It is also an object of the present invention to provide a liquid ring compressor in which problems associated with heating of the vanes are avoided as far as possible.

This object is achieved by means of the features of the invention that are indicated in the following claims.

The liquid ring compressor according to the invention can be used as an ordinary compressor/pump or as a vacuum pump. The liquid ring compressor according to the invention comprises a rotating compressor casing. The compressor casing may comprise two end walls, which are mounted by means of two bearings in two pedestals and a foundation frame. To a great extent it will be up to the skilled person to locate and adapt the mounting of the compressor casing relative to a base, depending on the area of application for the compressor. The actual mounting of the compressor casing forms no part of the invention and will therefore not be discussed further here.

The compressor casing has an axis of rotation A. In relation to this axis of rotation the compressor casing comprises an eccentrically located shaft journal with a centre axis B. The shaft journal has a surrounding bearing. This bearing may be a standard ball bearing, or it may be a magnetic bearing for mounting an internal surface of at least one compressor wheel. The compressor wheel, which is freely rotatingly mounted on the shaft journal inside the compressor casing, has at least one outwardly protruding vane. The vanes on the compressor wheel may be straight or curved in shape. The shape and number of vanes on the compressor wheel will depend on the area of application for the compressor as well as the size and working pressure for the compressor.

When the compressor casing is rotated, a liquid ring is created against the inner wall of the rotating compressor casing. The compressor wheel's vanes extend outwards and into the liquid ring. The compressor wheel is thereby drawn round by the established liquid ring. The compression chambers in the compressor are formed by the liquid ring together with the compressor wheel and its vanes. On account of the compressor wheel's eccentric mounting about an axis of rotation B in the compressor casing, the volume of the compression chambers varies with a rotation of the compressor casing and the compressor wheel. The compressor casing has inlet and outlet ports from the compression chambers.

According to the invention the liquid ring compressor further comprises at least one magnetic element mounted in the compressor casing. The magnetic element(s) is located adjacent to the compressor wheel with the result that, when the compressor casing is rotated, the magnetic element(s) makes the free-running compressor wheel rotate at the same rotational speed as the compressor casing. This kind of enclosed rotational movement between compressor casing and compressor wheel is achieved for the compressor according to the invention by means of a simple construction. A good energy transfer is also obtained from the compressor casing to the compressor wheel without any significant loss since the energy transfer takes place over contact-free surfaces, i.e. there is no frictional loss in the system. The construction also has minimal maintenance requirements since there is no wear in the system.

The magnetic element(s) that ensure that the compressor wheel and the compressor casing rotate at the same speed may be mounted at several points on the compressor casing, but always in such a manner that it/they are located adjacent to the compressor wheel. An alternative is a magnetic element located at the side of the compressor wheel in the longitudinal direction of the axis of rotation for the compressor wheel. A magnetic element of this kind may be located near the axis of rotation for the compressor wheel or along a peripheral ring with a radius substantially corresponding to an outer radius of the vanes on the compressor wheel, or along a circumference located in the area between these two extremities. Individual magnetic elements may also be envisaged for each vane on the compressor wheel, mounted on/in the compressor casing. The magnetic elements may also be envisaged mounted radially outside the compressor wheel in the compressor casing's internal peripheral wall, against which the liquid ring is created.

The compressor according to the invention may comprise magnetic elements at both sides of a compressor wheel in the longitudinal direction of the axis of rotation for the compressor wheel. An advantage of having magnetic elements on both sides of the compressor wheel is that the axial forces on the compressor wheel are balanced. Another advantage is that the compressor can be designed to transfer greater rotational force.

The magnetic element mounted on the compressor casing is preferably a magnetic ring. The annular shape of the magnetic element will ensure that the compressor wheel is continuously influenced along its entire circumference, thus providing more reliable operation of the liquid ring compressor. From the production point of view it is also preferred for the magnetic element to be in the form of a magnetic ring. The magnetic ring may have alternate north pole and south pole zones along its circumference. The magnetic ring may be composed of north pole and south pole magnetic elements or it may be produced as a non-magnetised ring of a material containing components, fibres or powder that can be magnetised and where after production the ring can be treated in the desired manner and magnetised in a desired pattern depending on the compressor wheel, its number of vanes, the area of application for the compressor, etc. How the magnetic element is magnetised is also dependent on the design of the vanes.

Magnetic rings on each side of the compressor wheel may have the same pole zones immediately above each other or the pole zones may be offset around the circumference relative to each other.

Parts of or the whole compressor wheel may be magnetised in a pattern corresponding to the magnetic elements mounted on the compressor casing. This may be implemented, for example, by the vanes of the compressor wheel having a magnetic element at their outer edge or by the vanes being made of a material that can be magnetised, for example a metal or a composite wherein there are fibres/powder elements that can be magnetised, or a plastic material containing magnetisable powder.

The magnetic elements may be mounted directly on to the compressor casing or they may be placed in recesses in the compressor casing. One reason for placing the magnetic elements in recesses in the compressor casing is to protect the magnetic elements from wear, etc. For example, an annular magnetic element may be mounted in an annular cavity in the compressor casing, where the annular cavity has a centre corresponding to the compressor wheel's axis of rotation, or with a centre corresponding to the compressor casing's axis of rotation. When mounting the element in an annular cavity, a steel ring may also be placed in the cavity in such a manner that the magnetic ring is located adjacent to the compressor wheel and the steel ring is disposed at the opposite side of the magnetic ring relative to the compressor wheel. The steel ring will then act as a backing for the magnetic force lines from the magnetic ring.

The magnetic elements will normally be mounted with a gap of approximately 0.25–0.5 mm between the compressor wheel and the magnetic elements. This gives a non-contact construction without abrasion surfaces which is thereby also maintenance-free.

The components of the liquid ring compressor may consist wholly or partially of different materials such as, for example, plastic, aluminium, steel alloys or composites. Those parts of the liquid ring compressor that are to be magnetised may be made of a magnetisable material. This may include metals, but also plastics or composites mixed with particles or fibres that can be magnetised.

The material of the compressor wheel may be a material that is a very good conductor of the magnetic force lines, e.g. soft steel, but it may also be a chrome steel if there is a need for a non-corrosive construction. The material in the end walls of the compressor casing may be varied depending on the area of application for the compressor, but may well be aluminium.

When substantial rotary energy has to be transferred from the magnetic elements mounted in the rotating compressor casing to the free-running compressor wheel, for example where the compressor wheel is very wide or the compressor has to work against extremely high pressure, the energy transfer can be reinforced by designing the compressor wheel in a material that can also be magnetised. Another alternative is to have a central portion of the compressor wheel relative to the axis of rotation made of a non-magnetic material, and the two end portions each facing a magnetic element made of a magnetic material, where these end portions are magnetised in a pattern corresponding to the adjacent magnetic elements. In order to obtain good conduction of the magnetic lines and less heat build-up in the vanes, in an embodiment the compressor wheel's vanes may be constructed with a laminated structure. The laminated structure may be constructed with the layers divided in a direction parallel to or across the compressor wheel's axis of rotation.

The compressor according to the invention has a number of areas of application. Some examples that may be mentioned are as part of a unit employed for heating, cooling and/or ventilation for rooms, buildings, be it a private house or business premises, flats, mobile homes, boats, vehicles such as cars, trains, etc. The compressor may also be used as a part of a unit for commercial refrigeration/freezing, such as for example refrigerators, cold-storage chambers, freezing plants. The compressor according to the invention may also be used in units that provide heating/cooling dependent on the ambient temperature, such as thermal units that maintain given temperatures for food, for example. In the field of industrial use, the compressor according to the invention can be employed where excess heat requires to be exploited and/or transferred from one medium to another or where a medium has to be compressed from one pressure level to another, or in order to create negative pressure or move a medium from one place to another, for example in the food industry, the pharmaceutical industry or the processing industry. The compressor may also form part of an air conditioning plant, a heat pump or a ventilation plant.

The invention will now be explained in greater detail by an embodiment with references to attached drawings in which.

Figure 1:
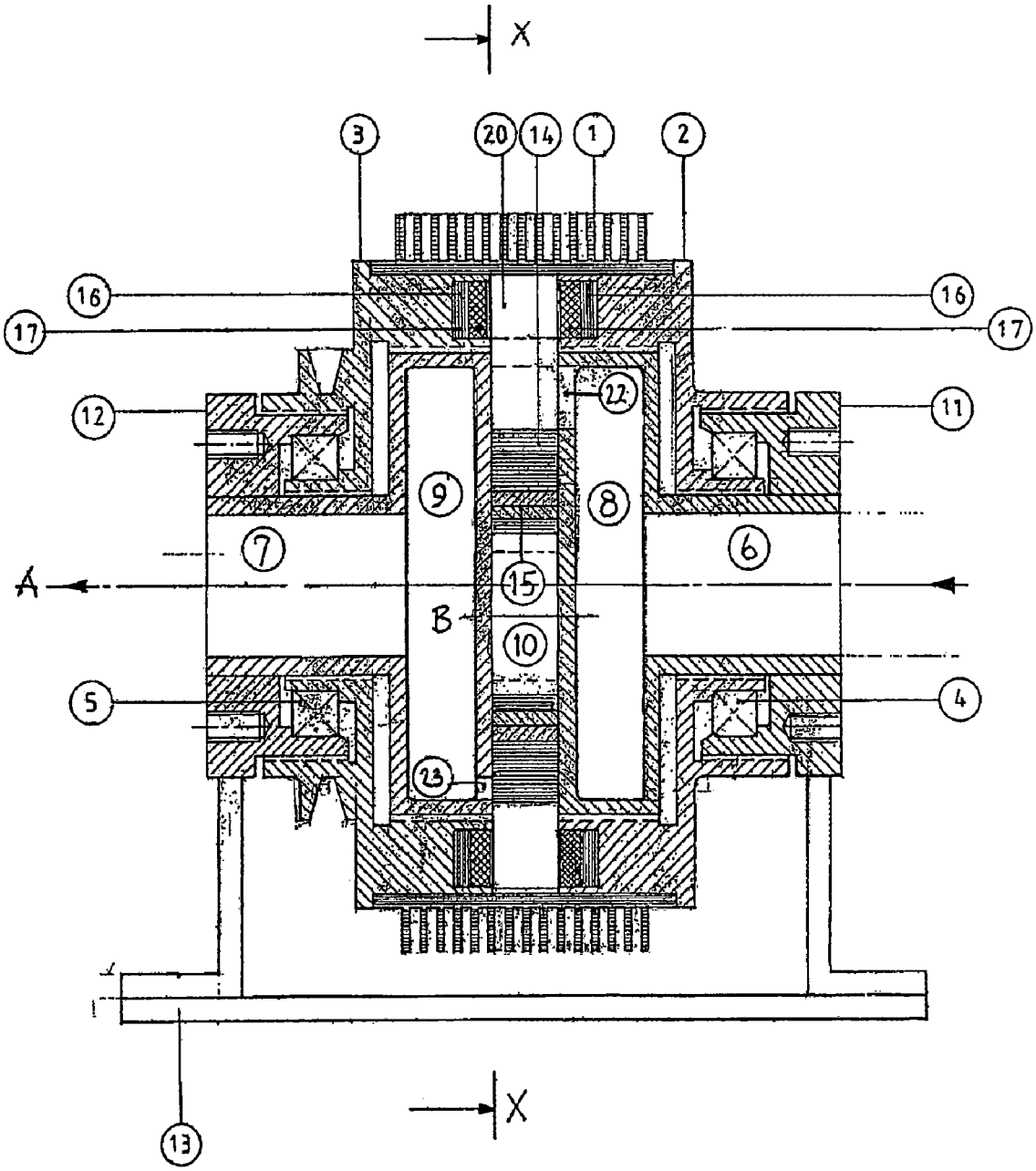
FIG. 1 is a longitudinal view along the axis of rotation for a liquid ring compressor according to the invention.

As illustrated in FIG. 1, the liquid ring compressor according to the invention comprises a cylindrically shaped rotating compressor casing 1. The compressor casing comprises two end walls 2,3, which have an orientation substantially vertically to the axis of rotation for the compressor casing. On its cylindrical exterior the compressor casing may have ribs as indicated in FIG. 1 to ensure good heat transfer from the compressor casing to the environment. The end walls 2,3 are each mounted round a support bearing 4 and 5 respectively, thus enabling the compressor casing 1 with the end walls 2,3 to rotate about an axis of rotation designated A in the figures. The support bearings 4,5 are each mounted on a pedestal 11 and 12 respectively and the pedestals 11 and 12 are affixed to a foundation frame 13. For the sake of clarity, the drive unit for the rotating compressor casing is not illustrated in the figures.

In the pedestals 11 and 12 there is affixed an eccentric piece, comprising two cylindrical pipe sockets 6 and 7 affixed to the pedestals 11, 12, each connected to a support bearing 4, 5. The pipe sockets' longitudinal direction and centre axes are substantially coincident with the compressor casing's axis of rotation. In the extension of the opposite ends of the pipe sockets 6, 7 two cylindrical chambers 8 and 9 respectively are affixed. These cylindrical chambers also have centre axes coincident with the compressor casing's axis of rotation. Between the two cylinder chambers 8, 9 there is mounted a compressor wheel 14. The compressor wheel 14 is mounted in a freely rotatable manner on a wheel bearing 15, and the wheel bearing 15 is mounted round a shaft journal 10. The shaft journal 10 is affixed to the cylinder chambers 8, 9 and has a centre axis designated B in FIG. 1, parallel to the compressor casing's axis of rotation A, but is eccentrically located relative thereto. This results in the compressor wheel rotating about an axis of rotation B which is eccentric relative to the compressor casing's axis of rotation A.

Figure 2:
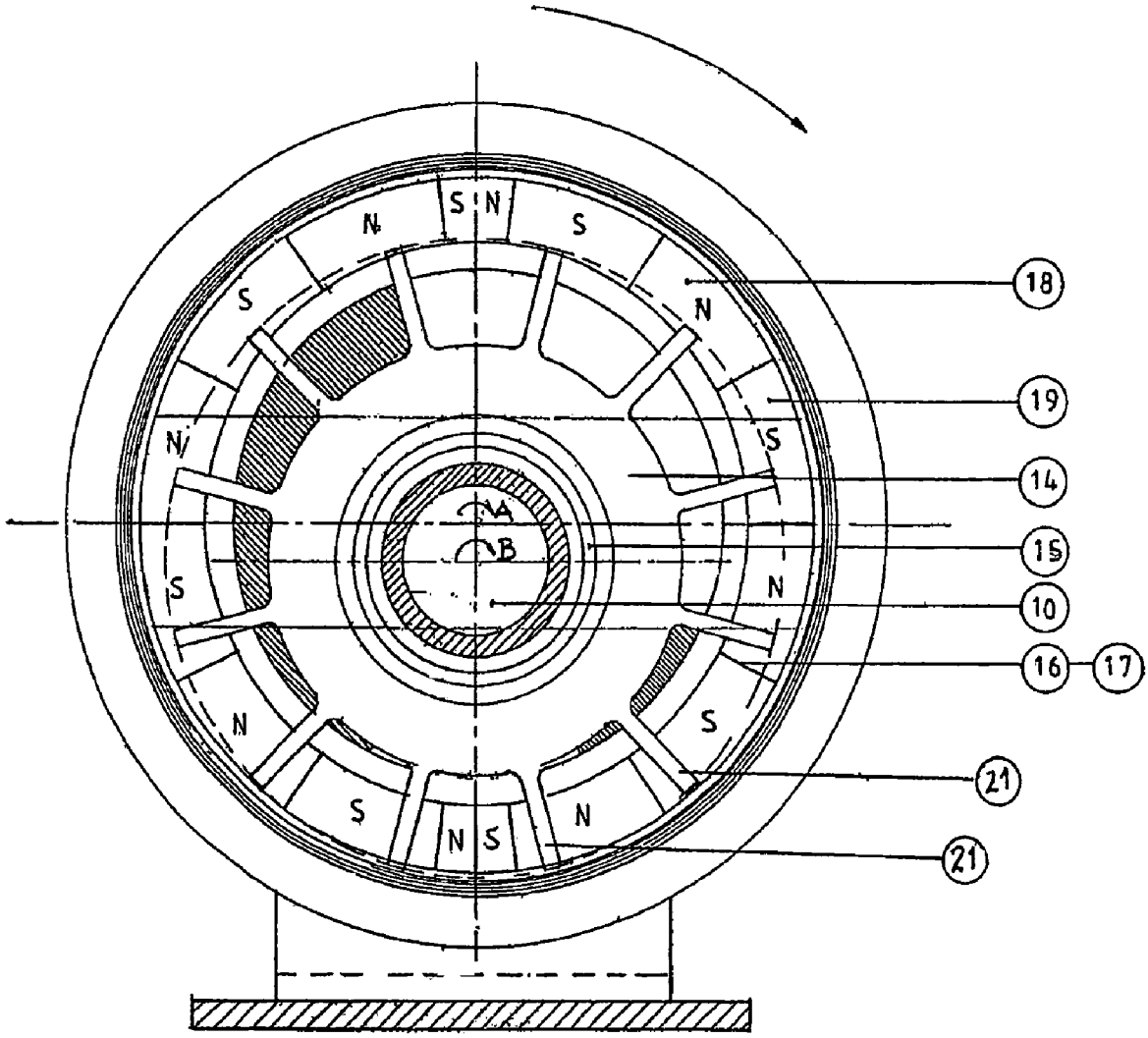
FIG. 2 is a cross-sectional view along line X—X in FIG. 1.

As illustrated in FIG. 2 the compressor wheel 14 comprises twelve radially outwardly protruding vanes 21. In the compressor casing is a liquid, which when the compressor casing 1 is rotated, creates a liquid ring 20 along the inner wall of the rotating compressor casing 1. The compressor wheel's vanes 21 extend radially outwards and into the liquid ring 20. The compressor's compression chambers are defined by the compressor wheel 14, its vanes 21 and the liquid ring 20, and in the direction of the axes of rotation, the compressor casing 1 and the cylinder chambers 8, 9. Due to the compressor wheel's eccentric mounting, the volume of the compression chambers will vary with rotation of the compressor casing 1 and the compressor wheel 14. At least at two different points along the curve of rotation for the compression chambers, there is an inlet port 22 and an outlet port 23, or in other words a port 22 for the suction gas and a port 23 for the pressure gas. These ports 22, 23 lead from the compression chambers to the two cylindrical chambers, 8 and 9 respectively, where in a normal flow direction a fluid will be conveyed from the cylinder chamber 8, which for the compressor wheel is a suction chamber, through the port 22 into the compression chambers, and the fluid is further conveyed from the compression chambers through the port 23 into the cylinder chamber 9, which is a pressure chamber. Alternatively, in the opposite direction if the device is used as a vacuum pump.

In the compressor casing 1, on each side of and adjacent, of the compressor wheel 14 there is provided an annular recess, wherein a steel ring 16 is disposed in the bottom of the recesses and outside this steel ring, adjacent to the compressor wheel 14, a magnetic ring 17. As illustrated in FIG. 2, this magnetic ring 17 may have a centre axis corresponding to the compressor casing's 1 centre axis. Alternatively, the centre axis may be similar to the compressor wheel's 14 centre axis. The size of the magnetic ring is such that it is aligned with the outer parts of the compressor wheel's vanes 21. The radial width of the magnetic ring 17 is also such that it is located adjacent to the side of the compressor wheel's vanes 21, along the entire circumference of the magnetic ring, even though the compressor wheel 14 and the magnetic ring 17 have different centre axes. As illustrated in FIG. 1, magnetic rings are mounted with a steel ring 16, which is located behind, in relation to the compressor wheel on both siides of the compressor wheel.

The magnetic ring 17 comprises alternate north pole zones 18 and south pole zones 19, and an suitable division of the magnetic ring into north and south pole zones for a compressor wheel with twelve straight vanes is illustrated in the figures. The pattern in the magnetic element/ring will vary depending on the number of vanes, and the shape of the vanes. The north pole and south pole zones can be applied to the magnetic ring after production in the pattern desired for the compressor concerned.

Figure 3:
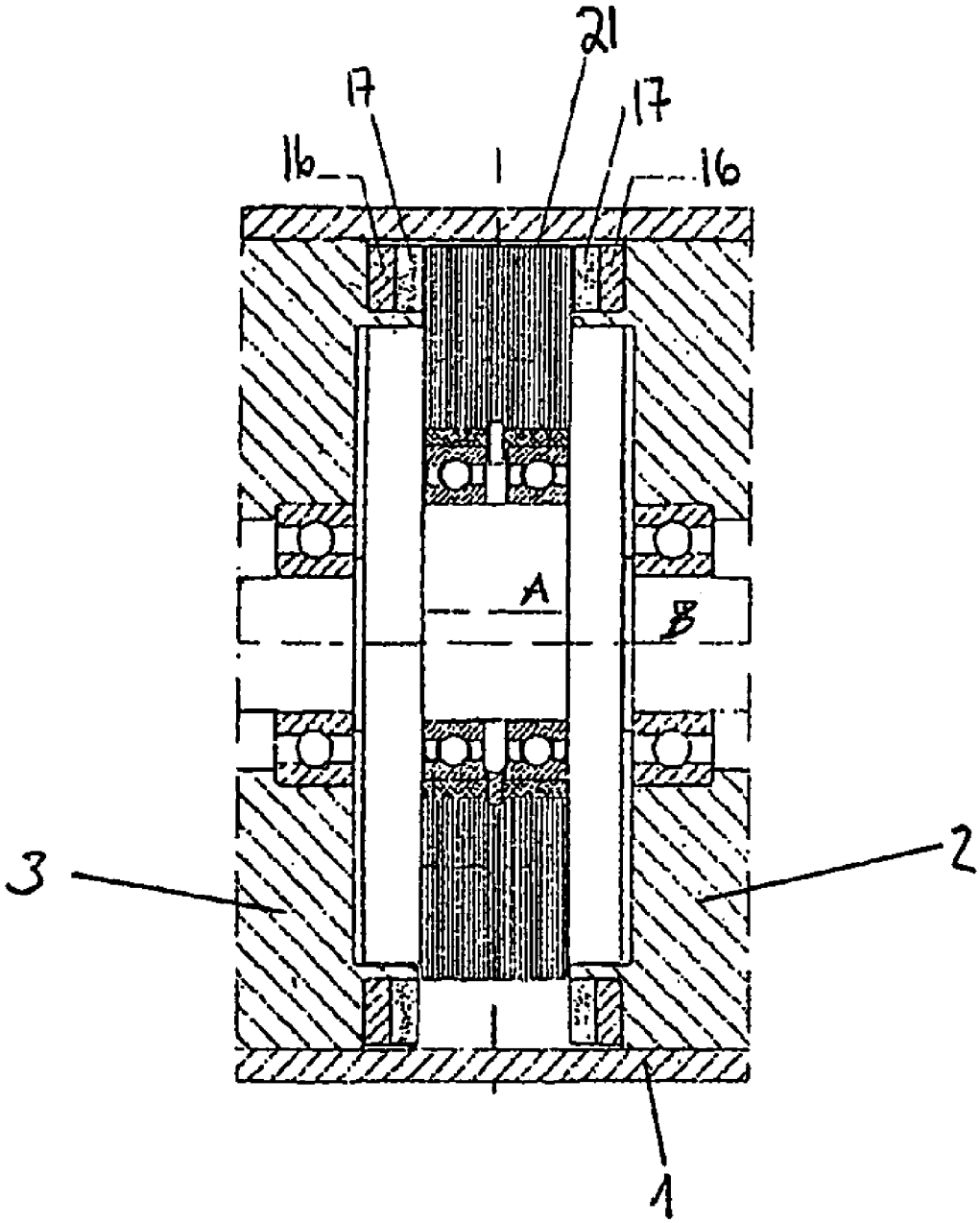
FIG. 3 illustrates an embodiment of the liquid ring compressor with laminated structure in the vanes.
Figure 4:
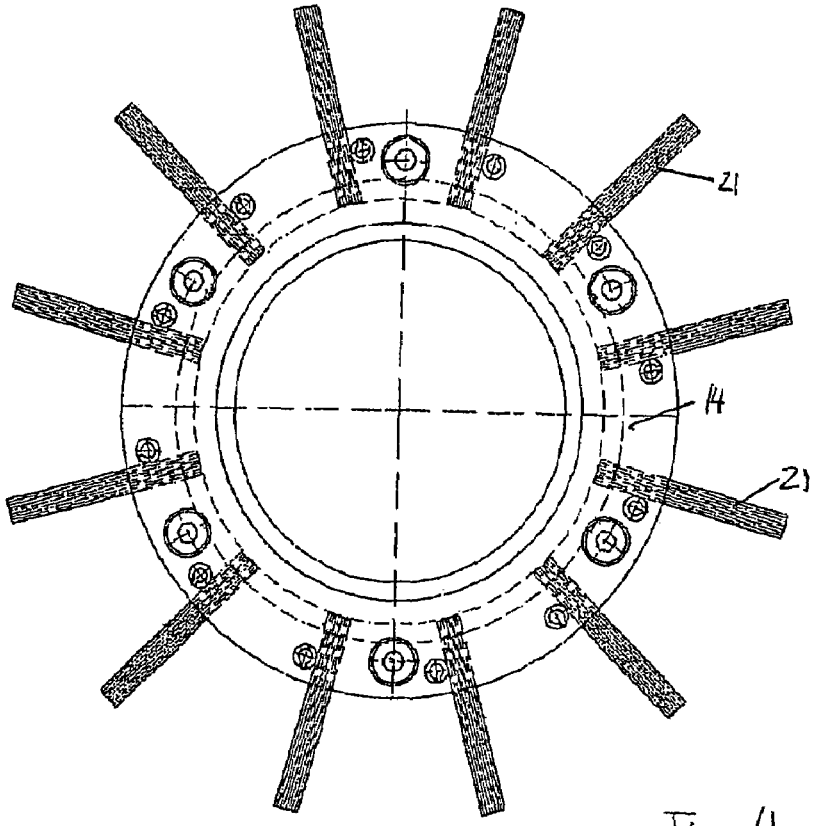
FIG. 4 illustrates a second embodiment of the liquid ring compressor with laminated structure in the vanes.
Figure 5:
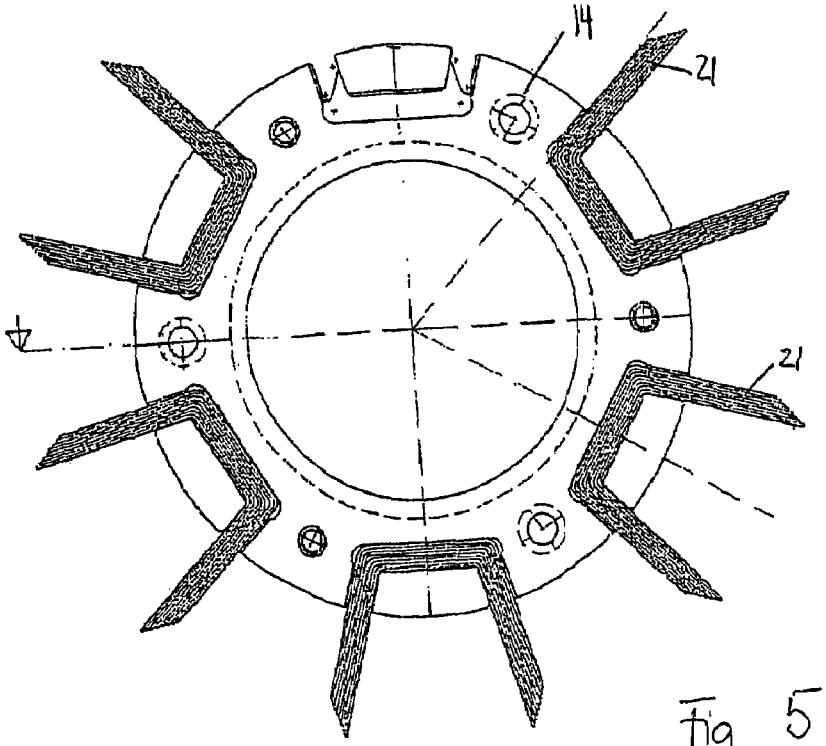
FIG. 5 illustrates a third embodiment of the liquid ring compressor with laminated structure in the vanes.

As illustrated in FIGS. 3–5, in a preferred embodiment the vanes 21 are composed of a laminated structure. When using magnetic forces for more reliable operation of a liquid ring compressor, when vanes are employed in a uniform material, a problem is generally encountered with undesirable heating of the vanes and eddy-currents in the force lines round the magnetic elements. By designing the vanes 21 of the compressor wheel 14 with a laminated structure, with thin sheets of conductive material with insulation between the sheets, a conduction of the flow lines through the vanes is achieved, thus reducing the problems of heating and formation of eddy-currents in the force lines. The vanes 21 may be formed by constructing a laminated structure parallel to the axis of rotation, as illustrated in FIG. 3 or by constructing the laminated structure across the axis of rotation as illustrated in FIGS. 4 and 5. In FIG. 3 each vane is constructed with a laminated structure so that the force lines are led from a point on the compressor casing to a second point on the compressor casing on the same side of the compressor casing as the first point. In FIGS. 4 and 5 the vanes 21 have a laminated structure, which is constructed with a direction across the axis of rotation, with the result that, amongst other things, the force lines can be led from one side of the compressor casing to another side of the compressor casing through the vanes. In FIG. 5 a third and preferred embodiment of the vanes is illustrated, where pairs of vanes are composed of a common laminated element. A sheet in the laminated structure extends through one vane, on through a straight portion in the interior of the compressor wheel and out in the second vane, with the result that if the laminated structure element is seen from one side, it forms a U-shaped element. The bottom of the U-shaped element is affixed to the compressor wheel and the legs of the U form the vanes. The ends of the vanes in this embodiment have been given a sloping termination, thus providing a larger end termination surface for the layers in the laminated structure, which is advantageous for obtaining a good conduction of the force lines. By providing the vanes in pairs in this manner, force lines are also obtained in two directions, through the vane structure from one side to the other side and through the U-shape from one vane to the other vane. By forming the vanes in pairs from a common laminated structure element, a simple attachment of the vanes to the compressor wheel is also obtained. The U-shape can be disposed in a complementary U-shaped recess in the compressor wheel and secured. This may be achieved, for example, with a recess that extends inwards from one side of the compressor wheel in such a manner that the vane element is inserted in the recess by moving it into the recess with a movement parallel to the axis of rotation for the compressor wheel and where the vanes are kept in place by attaching a holding element to the side of the compressor wheel. A holding element of this kind can act as a holding element for one, more or all of the pairs of vanes.

The laminated structure in the vanes may be composed, for example, of core plates which are varnished on both sides. Sheet metal is a very good conductor of force lines and a layer of varnish on the surface of the sheet metal facing a second plate will provide the necessary insulation between the layers of sheet metal. Other materials may, of course, be envisaged here both for conducting the force lines and for insulation between the layers. The choice of material will naturally also be dependent on the use of the liquid ring compressor and its size.

In the above the invention is explained by an embodiment. A number of variants of this may be envisaged within the scope of the invention as it is defined in the following claims. A plurality of compressor wheels may be envisaged mounted in the compressor casing in the longitudinal direction of the axis of rotation, thus providing a multistage compressor unit or there may be several such compressor wheels. The inner wall of the compressor casing with inlet and outlet ports and the compressor wheel may be envisaged designed in such a manner that a rotation of the compressor casing gives two "compression cycles" per rotation. The liquid ring compressor must be equipped with seals between the individual parts. The choice of type of seal is not dependent on the invention and will be up to a person skilled in the art.

The invention claimed is:

1. A liquid ring compressor and/or pump, comprising a rotating compressor casing (1), a shaft journal (10) eccentrically located relative to the compressor casing's axis of rotation, with a surrounding bearing (15), one or more compressor wheels (14) with at least one vane, disposed in the compressor casing with the inside of the compressor wheel (14) in abutment against and rotating around the bearing (15) and inlet and outlet ports for the fluid that has to be compressed, with the result that when the compressor casing is rotated, a liquid ring (20) is created against the inner wall of the rotating compressor casing (1), which liquid ring (20) together with the compressor wheel (14) forms compression chambers, characterised in that the liquid ring compressor further comprises at least one magnetic element mounted in the compressor casing (1) adjacent to the compressor wheel (14), where when the compressor casing (1) is rotated, the magnetic element makes the free-running compressor wheel (14) rotate at the same rotational speed as the compressor casing (1).

2. A liquid ring compressor according to claim 1, characterised in that the compressor casing (1) comprises magnetic elements on each side of the compressor wheel (14) in the longitudinal direction of the axis of rotation.

3. A liquid ring compressor according to one of the above-mentioned claims, characterised in that the magnetic elements are composed of one or more magnetic ring(s) which have alternate north pole (18) and south pole zones (19) along their circumference.

4. A liquid ring compressor according to claim 3, characterised in that the magnetic rings (17) on each side of a compressor wheel (14) either have the same pole zones or the pole zones are offset relative to each other.

5. A liquid ring compressor according to claim 4, characterised in that the magnetic ring (17) and a steel ring (16) are mounted in an annular cavity in the compressor casing (1), where the magnetic ring (17) is located adjacent to the compressor wheel (14) and the steel ring (16) is disposed at the opposite side of the magnetic ring (17) relative to the compressor wheel (14).

6. A liquid ring compressor according to one of claim 5, characterised in that parts of or the whole compressor wheel's vanes (21) are magnetised with a pattern substantially corresponding to the magnetic ring(s) (17).

7. A liquid ring compressor according to claim 6, characterised in that the compressor wheel (14) is made of a material that conducts magnetic force lines.

8. A liquid ring compressor according to one of claim 6, characterised in that the whole or parts of the compressor wheel (14) are made of a material that can be magnetised in a desired pattern.

9. A liquid ring compressor according to claim 4, characterised in that the compressor wheel's (14) vanes (21) are composed of a laminated structure, which laminated structure is constructed by being divided into layers in a direction parallel to or across the compressor wheel's axis of rotation.

10. A liquid ring compressor according to claim 9, characterised in that the compressor wheel's (14) vanes are in pairs and composed of a common laminated structure element, where a layer in the laminated structure element has at least one surface dimension portion parallel to the axis of rotation for the compressor wheel, and at least two surface dimension portions across the axis of rotation.

* * * * *